United States Patent [19]

Burson

[11] 3,949,338

[45] Apr. 6, 1976

[54] IGNITION COIL

[75] Inventor: Bob O. Burson, East Longmeadow, Mass.

[73] Assignee: R. E. Phelon Company, Inc., East Longmeadow, Mass.

[22] Filed: June 10, 1974

[21] Appl. No.: 477,965

[52] U.S. Cl. ..... 336/92; 336/96; 336/107

[51] Int. Cl.[2] ..... H01F 27/02

[58] Field of Search ..... 336/84, 92, 96, 105, 107, 336/192; 123/148 D

[56] References Cited

UNITED STATES PATENTS

| | | | |
|---|---|---|---|
| 1,647,417 | 11/1927 | Schneider | 336/92 |
| 1,657,002 | 1/1928 | Gragg | 336/92 X |
| 1,792,730 | 2/1931 | Chryst et al. | 336/96 X |
| 1,854,401 | 4/1932 | Fitzsimmons | 336/96 X |
| 1,864,460 | 6/1932 | Norviel | 336/96 X |
| 2,978,659 | 4/1961 | Wahlgren | 336/96 |

*Primary Examiner*—Thomas J. Kozma

*Attorney, Agent, or Firm*—McCormick, Paulding & Huber

[57] ABSTRACT

An ignition coil for use in the ignition system of a spark-ignited internal combustion engine consists of a small number of parts capable of being assembled into a complete unit by a simple assembly method. The method is such that some of its basic steps may be carried out on a batch of units at one time to reduce the per unit assembly time and expense. The coil may be either double ended or single ended with regard to its secondary winding.

1 Claim, 14 Drawing Figures

IGNITION COIL

BACKGROUND OF THE INVENTION

This invention relates to ignition coils for spark-ignited internal combustion engines, and deals more particularly with improvements in the construction of such coils.

Although the ignition coil of this invention may be used with various different types of spark-ignited internal combustion engines, it is particularly well adapted for use with relatively small single cylinder or double cylinder engines such as conventionally used to power chain saws, lawn mowers, snow blowers, and similar tools requiring low horsepower drives. Such engines are usually made in large numbers for highly competitive markets so it is desirable that the cost of manufacture be reduced as far as possible. On the other hand, such engines are often used in applications requiring their frequent stopping and starting and, therefore, their ignition systems should be especially reliable to insure ease of starting. In keeping with these requirements, the ignition coil of this invention is one which may be made at relatively low cost since it is made of a small number of parts which may be assembled in accordance with an efficient method comprising another aspect of the invention. Furthermore, the ignition coil of the invention, despite its economy and ease of manufacture, is one having high reliability and operating efficiency together with long service life. It further, with little change, may be made either single ended or double ended with regard to its secondary winding. The single ended construction may be used with single cylinder engines or with multi-cylinder engines having a distributor in the ignition system. The double ended construction is particularly well adapted for use with two cylinder engines which do not include distributors in their ignition systems.

Other objects and advantages of the invention will be apparent from the following detailed description thereof and from the appended drawings forming a part thereof.

SUMMARY OF THE INVENTION

The invention resides in an ignition coil for an internal combustion engine comprised of a tubular shell initially open at both ends. One end of the shell is closed by a coil head partially received in the shell and having an axial recess supporting one end of an elongated core also received in the shell and carrying a secondary winding. The remaining space inside the shell is filled with a potting material which by itself closes the other end of the shell and forms a wall between such other end and the secondary winding and core. A primary winding is wound on the outside of the shell and radially outwardly extending flanges are provided at opposite ends of the shell between which the primary winding is wound, one flange being integral with the shell and the other flange being integral with the coil head. A protective cylindrical jacket surrounding the primary winding may also be provided and the annular flanges are preferably provided with circular rabbets for receiving the adjacent end portions of such jacket. If the jacket is made of an electrically conductive material, it also preferably includes a longitudinal slit to inhibit the flow of electrical current therethrough in a path surroundng the core.

DETAILED DESCRIPTION OF THE PREFERRED EMBODIMENTS

Figure 1:
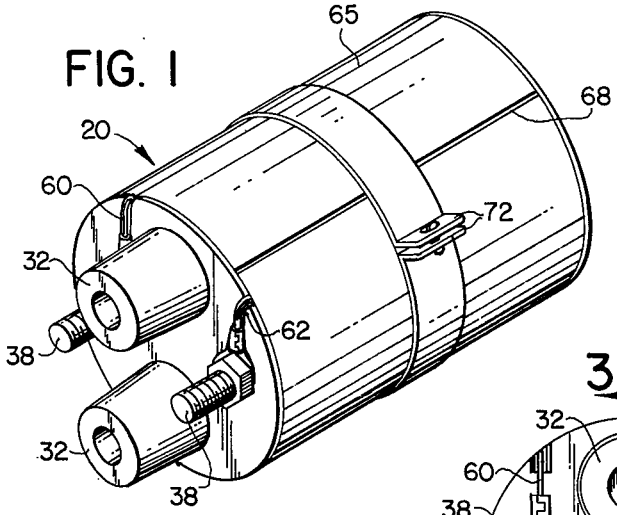
FIG. 1 is a perspective view of a double ended ignition coil embodying this invention.

Referring first to FIGS. 1 to 4, these figures show a double ended ignition coil 20 embodying this invention. As shown best in FIGS. 3 and 4, this coil 20 comprises a generally cylindrical tubular shell 22 preferably made of a plastic, electrically non-conductive material. In and of itself, the shell 22 is open at both of its ends and has an inner cylindrical surface 24 coaxial with an outer cylindrical surface 26. At its right-hand end in FIG. 3 it has a radially outwardly extending annular flange 28 providing an annular radially extending shoulder surface 29 facing axially toward the opposite or left-hand end of the shell.

Figure 3:
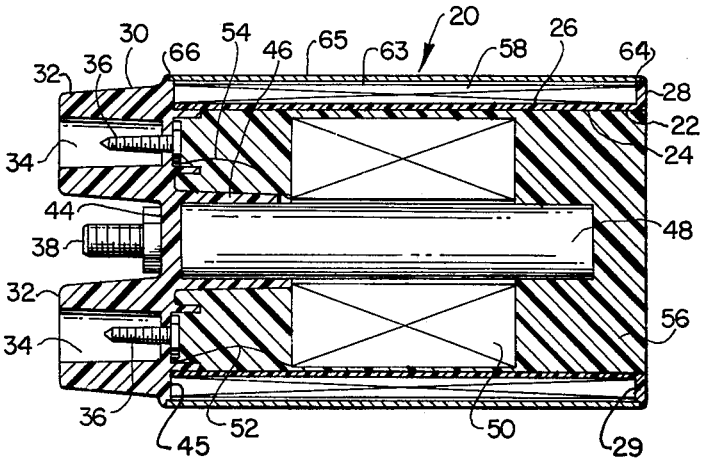
FIG. 3 is a longitudinal sectional view taken on the line 3—3 of FIG. 2.

The left-hand end of the shell 22, as viewed in FIG. 3, is closed by a coil head 30 made of molded plastic, electrically non-conductive material and including two outwardly extending high-tension towers 32, 32. Each tower 32 has an axially extending recess 34 adapted to receive an end portion of a high-tension lead of the type conventionally used in internal combustion engine ignition systems. Two high-tension terminals 36, 36 are provided, each passing through the coil head 30 so as to have a head portion exposed to the interior of the shell 22 and a spike portion received in a respective one of the recesses 34, 34 for making electrical connection with a lead inserted in the recess. As viewed in FIG. 4, the coil head 30 also carries two low-tension terminals 38, 38. These two terminals also pass through the coil head so that each has a head portion, exposed to the interior of the shell 22, and an outer portion preferably threaded to receive an associated nut 40.

Figure 4:
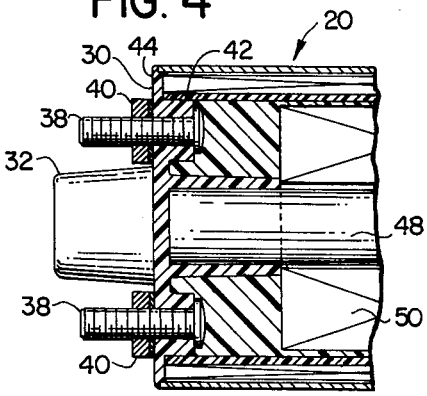
FIG. 4 is a partial longitudinal sectional view taken on the line 4—4 of FIG. 2.

On its interior or right-hand side as viewed in FIGS. 3 and 4, the coil head 30 includes a cylindrical axially extending portion 42 having a cylindrical outer surface and which extends axially into and fits closely with the cylindrical inner surface of the adjacent end portion of the shell 22 to center the coil head with respect to the shell and to prevent the coil head and shell from moving relative to one another in a plane perpendicular to the axis of the shell. The coil head further includes an annular flange 44 which extends radially outwardly beyond the shell 22. The flange 44 is generally similar to the flange 28 at the opposite end of the shell and provides an annular radially extending shoulder surface 45 facing axially toward the other shoulder surface 29.

At the center of its interior or right-hand side, as viewed in FIGS. 3 and 4, the coil head 30 has an axially extending boss or chimney 46 which is recessed to receive one end of an elongated ferromagnetic core 48, preferably of circular cross section, which extends from the coil head 30 to a point spaced slightly inwardly from the opposite end of the shell 22. Received on the core 48 is a secondary winding 50 having one end 52 thereof connected to one of the high-tension terminals 36 and having its other end 54 connected to the other high-tension terminal 36. The coil head chimney 46 extends along the core 48 to the adjacent face of the secondary winding 50 and, therefore, through coengagement of the chimney and secondary winding, serves to properly locate the secondary winding in the shell 22.

The aforesaid secondary winding 50 and core 48 are, except for potting material, the only items located within the shell 22. The remaining space within the shell 22 is filled with a potting material, indicated at 56, which extends beyond the left-hand ends of the secondary winding 50 and core 48, as viewed in FIG. 3, and forms a wall between the winding 50 and core 48 completely closing the left-hand end of the shell.

Figure 2:
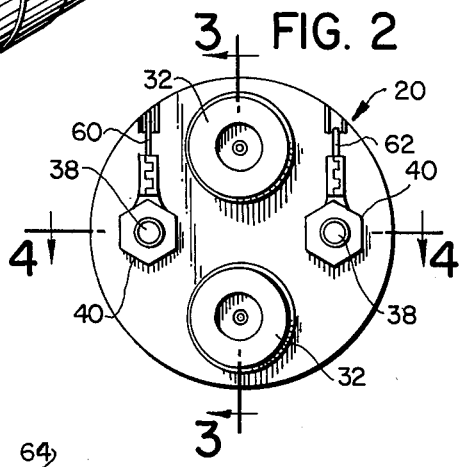
FIG. 2 is an end elevational view of the left-hand end of the ignition coil of FIG. 1.

A primary winding 58 is received on the outside surface 26 of the shell 22 between the two annular flanges 28 and 44. The opposite ends, 60 and 62, of this primary winding are connected respectively to the low-tension terminals 38, 38 as best shown in FIGS. 1 and 2.

The primary winding may in some instances be left exposed, but usually, and as shown in the construction of FIGS. 1 to 4, some protection is provided for it. In these figures, the protection for the primary winding comprises a layer 63 of insulating tape wound around the outside of the primary winding 58 and a protective jacket 65 overlying the tape 63. Both the tape and the jacket extend the full length of the space between the two flanges 28 and 44 and preferably each of these flanges is provided with a circular rabbet, indicated at 64 and 66 in FIG. 3, for accommodating the adjacent end of the jacket 65. The jacket 65 may be made of either an electrically conductive material or an electrically nonconductive material. If made of an electrically conductive material, it preferably includes a longitudinal slit as shown at 68 in FIG. 1 to prevent the flow of electrical current therethrough in a direction encircling the core 48. If the jacket includes a slit 68, the coil 20 also preferably includes some means for keeping the jacket from spreading apart at the slit, and in FIG. 1, such means is shown as a band 70 encircling the jacket.

The band 70 also may be made of either an electrically conductive or electrically nonconductive material and if made of an electrically conductive material, it is preferably of a relatively small axial dimension to restrict the flow of currents encircling the core 48. The illustrated band 70 includes two radially outwardly extending end portions 72, 72 which are apertured to receive a fastener which may be used to both tighten the band around the jacket and to hold the coil 20 to a suitable mounting bracket or the like.

The potting material 56 is used in the construction of the coil 20 is one, such as an epoxy resin, which may be introduced to the shell in a liquid state and later hardened, the potting material being in a hardened state in the finished coil. In addition to closing the right-hand end of the shell, as viewed in FIG. 3, the potting material 56 also serves to hold the core 48, the primary winding 50, the shell 22 and the coil head 30 in rigid assembly with one another so that no other fastening means between these parts are required. Additionally, the potting material permeates the spaces between the convolutions of the secondary winding 50, the space between the secondary winding and the core, and the space between the winding convolutions and the insulating paper which may be used between various layers of the winding, to provide an additional insulating effect and to eliminate air pockets. If air pockets do exist, the high voltages encountered during use of the coil may ionize the air in such pockets and cause a corona discharge which has a debilitating effect on the insulating coating applied to the wire and on the paper which may be used to insulate winding layers from one another.

Figure 5:
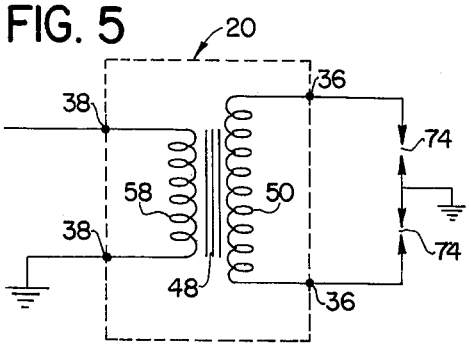
FIG. 5 is a schematic wiring diagram of the ignition coil of FIG. 1 and of part of an ignition system with which it is used.
Figure 6:
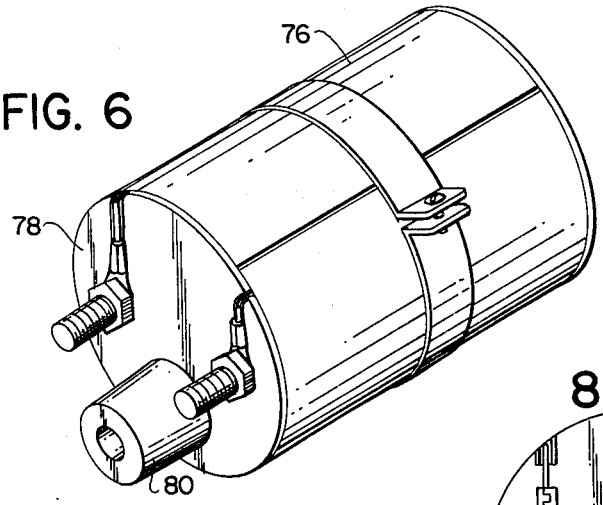
FIG. 6 is a perspective view of a single ended ignition coil comprising another embodiment of this invention.
Figure 7:
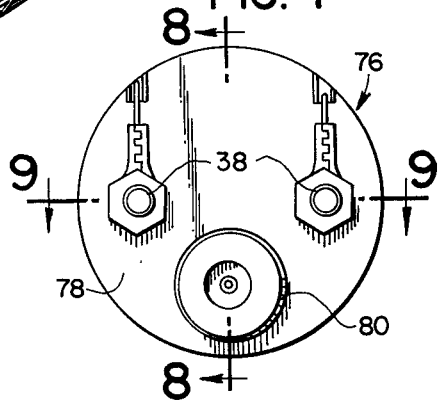
FIG. 7 is an end elevational view of the left-hand end of the coil of FIG. 6.
Figure 8:
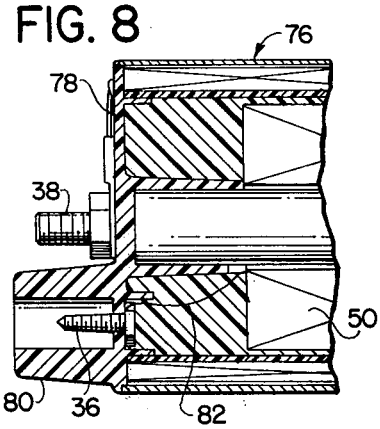
FIG. 8 is a partial longitudinal sectional view taken on the line 8—8 of FIG. 7.
Figure 9:
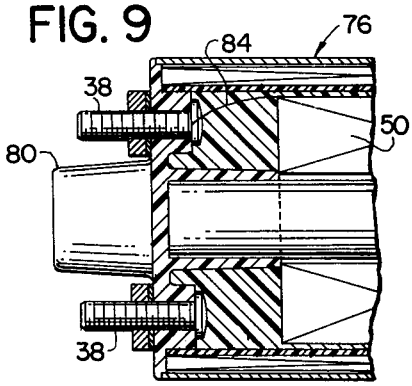
FIG. 9 is a fragmentary longitudinal sectional view taken on the line 9—9 of FIG. 7.

As mentioned above, the coil 20 of FIGS. 1 to 4, is a double ended coil in that both of the ends of its secondary winding 50 are connected to separate high-tension terminals. FIG. 5 is a schematic wiring diagram showing the coil 20 and the manner in which such coil is used in the ignition system of a two cylinder engine. Referring to this figure, one end of the primary winding 58 is connected to ground and the other end is connected to a source of current impulses, such as a conventional magneto or capacitor discharge circuit. The engine has two spark plugs 74, 74, one for each cylinder. Each spark plug has one electrode connected to ground. The secondary winding 50 of the coil 20 has one high-tension terminal 36 connected to the ungrounded electrode of one of the spark plugs 74 and its other high-tension terminal 36 connected to the ungrounded electrode of the other spark plug 74. Therefore, each time a current impulse is received by the primary winding 58, a high voltage impulse is induced in the secondary winding 50 which creates simultaneous sparks across the gaps of both of the spark plugs 74, 74. The engine timing in turn is such that when the sparks occur, one cylinder of the engine is ready for firing and the other cylinder is in an exhaust state at which the firing of its plug has no effect. That is, each time one of the cylinders of the engine is fired, a spark is produced at the plug of the other engine with no effect on the operation of the engine. This eliminates the need for a distributor in the ignition system. Further, the fact that both plugs are sparked simultaneously, with one spark being unnecessary for engine operation, has little effect on the efficiency of the ignition system because of the fact that consideraly higher voltage is required to fire a spark plug under compression than is required to fire a plug not under compression. Therefore, each time the two plugs are simultaneously sparked, the non-effective spark plug does not deprive the effective spark plug of an undue amount of voltage.

FIGS. 6 to 9 show an ignition coil 76 comprising an alternative embodiment of the invention and which coil 76 is identical to the coil 20 of FIGS. 1 to 4 except for being of a single ended construction. Accordingly, the parts of the coil 76 which are identical to corresponding parts of the coil 20 have been given the same reference numbers as in FIGS. 1 to 4 and need not be redescribed.

The difference between the single ended coil 76 and the double ended coil 20 resides in the coil head 78 of the coil 76 having a single high-tension tower 80 as compared to the two high-tension towers 32, 32 of the coil 20. Also, as shown best in FIGS. 8 and 9, one end 82 of the secondary winding 50, preferably the radially inner end, is connected to the single high-tension terminal 36. The other end 84 of the secondary winding 50 is connected to the inner portion of one low-tension terminal 38, this terminal 38 being the one intended for connection to ground when the coil 76 is installed in an ignition system.

Figure 10:
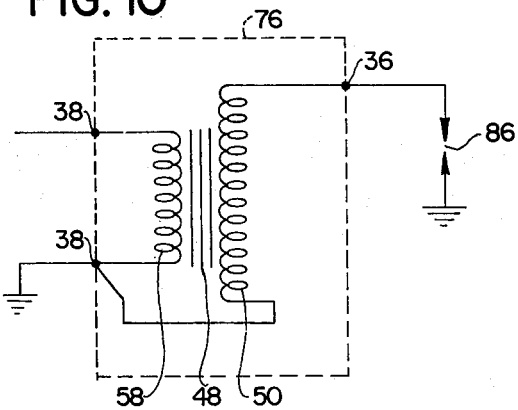
FIG. 10 is a schematic wiring diagram of the coil of FIG. 6 together with part of the ignition system with which it is used.

FIG. 10 shows the coil 76 in the ignition system of a single cylinder engine. As shown in this figure, the single high-tension terminal 36 of the coil is connected to the ungrounded electrode of the single spark plug 86 of the engine. The one low-tension terminal 38 to which the opposite end of the secondary winding is connected is connected to ground and the other low-tension terminal 38 is connected to a conductor which furnishes it with current impulses generated by an associated magneto, capacitor discharge circuit or the like operating in synchronism with the engine.

Figure 12:
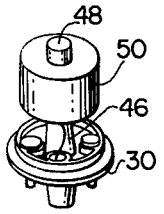
FIG. 12 is a perspective view of a subassembly used in making an ignition coil of this invention.

The ignition coil described above, in either one of its two illustrated embodiments, in addition to being comprised of a small number of parts also has the advantage of being capable of manufacture by a relatively simple process. Basically, this process involves making a subassembly, such as shown in FIG. 12, consisting of a coil head 30 (or 78), core 48 and secondary winding 50. In this subassembly, one end of the core 48 is received in the chimney 46 of the coil head and the upper end of the chimney 46 locates the primary winding 50 with respect to the coil head and core 48. Also in this subassembly, the two ends of the secondary winding 50 are connected to the appropriate ones of the terminals carried by the coil head. That is, if the subassembly is for making a double ended coil, the two ends of secondary winding are connected to the two high-tension terminals 36, 36. If the subassembly is one for making a single ended coil, one end of the secondary winding is connected to the one high-tension terminal 36 and the other end of the coil is connected to one of the two low-tension terminals 38, 38. The parts are preferably made so that they fit easily with one another and they may be designed to produce a slight frictional fit between the core 48 and chimney 46 and between the secondary winding 50 and core 48. However, such frictional fit is not entirely necessary for so long as the subassembly is maintained in the orientation of FIG. 12, the parts will be held together by gravity.

Figure 13:
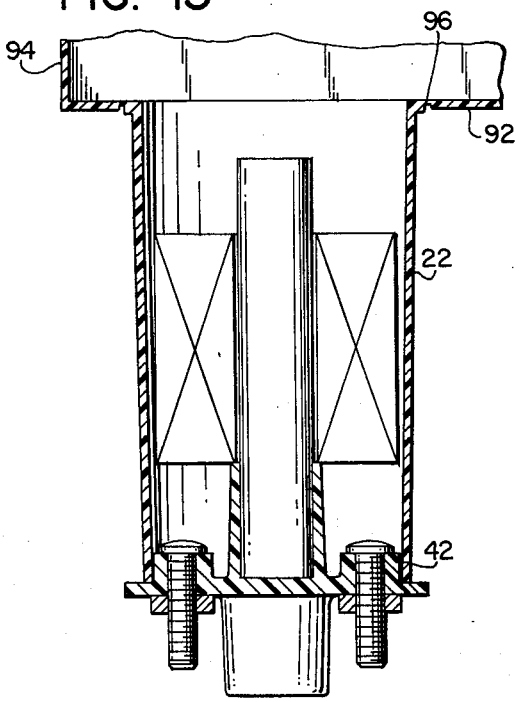
FIG. 13 is a longitudinal sectional view taken through one of the shells of the unit of FIG. 13 after the assembly therewith of a subassembly similar to that shown in FIG. 12 and prior to the introduction of potting material.

After a subassembly such as shown in FIG. 12 is provided, it is inserted in the lower end of a cylindrical shell 22, oriented as shown in FIG. 13. In this state of assembly, the cylindrical shoulder 42 on the coil head 30 through its engagement with the lower end of the shell 22 centers the subassembly relative to the shell 22. The fit between the shoulder 42 and shell 22 is preferably a frictional one and if desired, a detent or snap-action fit may be had between the coil head 30 and shell 22, but such frictional or snap fit is not entirely necessary and a somewhat looser fit may be used if desired.

After the parts are assembled to the state of FIG. 13, hardenable liquid potting material is introduced through the upper end of the shell 22 until the shell is substantially completely filled to above the level of the upper end of the core 48. The potting material is then hardened and the coil is completed by winding a primary winding around the outside of the shell and by applying the insulating tape 63, the jacket 65 and mounting band 70. Although ignition coils may be made one at a time in accordance with the method mentioned above, it is preferred that some of the assembly steps be carried out on a batch basis through the use of a molded plastic unit such as shown at 90 in FIG. 11. This unit 90 has a tray portion consisting of a bottom wall 92 and upwardly extending peripheral side walls 94, 94. Communicating with the bottom wall 92 are a plurality of cylindrical shells 22, 22, each of which, as best shown in FIG. 13, is connected with the bottom wall 92 by a weakened or thin annular section 96 allowing each shell to be readily separated from the bottom wall 92 and from the remainder of the shells 22, 22 by hand breaking. In making a batch of coils through the use of the unit 90 of FIG. 11, a plurality of subassemblies such as shown in FIG. 12 are provided and each is inserted into the lower end of a respective one of the plurality of shells 22, 22 provided by the unit 90. Then, the potting material, in its liquid state, is poured into the upper end of the unit 90 so as to flow simultaneously into all of the shells 22, 22 of the unit. After this pouring of the potting material, and after the potting material has hardened, the individual shells are broken from one another and from the bottom wall 92 and are subsequently each provided with a primary winding, an insulating tape layer and a jacket to form a finished coil.

Figure 11:
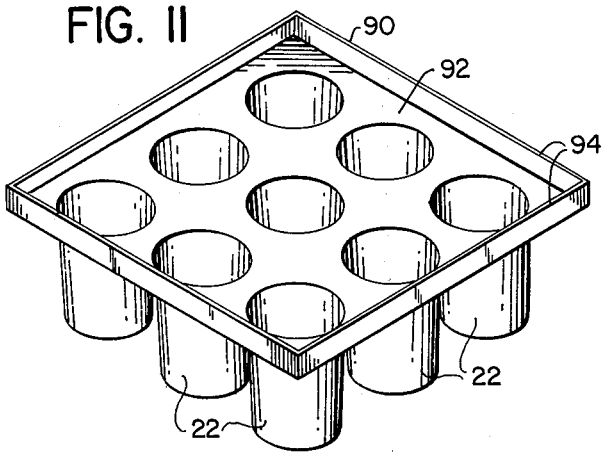
FIG. 11 is a perspective view of a tray and shell unit which may be used in making a batch of ignition coils in accordance with the method of this invention.
Figure 14:
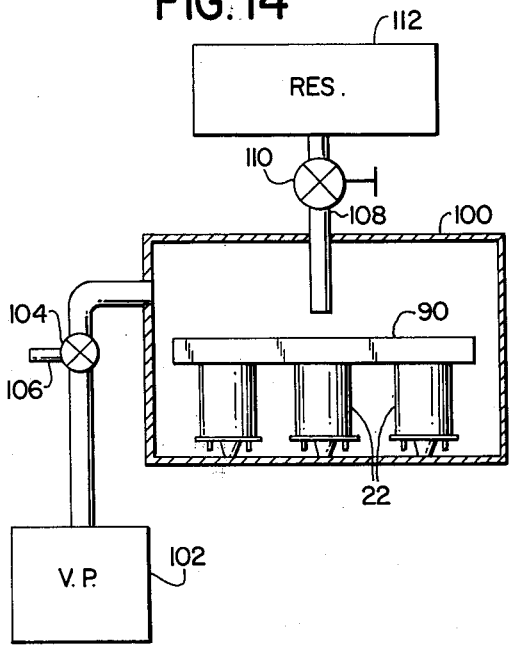
FIG. 14 is a schematic illustration showing an apparatus for introducing potting material to the shells of a unit such as shown in FIG. 11 while the shells and the subassemblies contained therein are under vacuum.

Further, it is preferred that the pouring of the liquid potting material into the shells be done while the awaiting assemblies are held under a vacuum and that after the pouring has taken place and before the potting material hardens the vacuum is released to cause the potting material to flow into all empty spaces under the influence of atmospheric pressure and to cause any voids or pockets which may nevertheless remain after the hardening or the potting material to be airless. An apparatus for accomplishing this is shown in FIG. 14 and consists of a vacuum chamber 100 connected to a vacuum pump 102 through a selector valve 104 which may be set to connect the chamber 100 either to the vacuum pump 102 or to atmosphere through a conduit 106. The chamber 100 is sufficiently large to receive a unit 90 such as shown in FIG. 11 having subassemblies, such as shown in FIG. 12, inserted through the lower ends of all of its shells 22, 22. Above the unit 90 is a conduit 108 connected through a valve 110 to a reservoir 112 containing liquid potting material. After a vacuum is drawn in the chamber 100, the valve 110 is opened to allow liquid potting material to flow through the conduit 108 into the top of the unit 90 and from thence into the various individual shells 22, 22. After all of the shells 22, 22 are filled with the potting material, the valve 110 is closed and the valve 104 set to turn off the vacuum and to introduce atmospheric pressure into the chamber.

I claim:

1. An ignition coil comprising a tubular shell open at both of its ends and having coaxial generally cylindrical inner and outer surfaces, an elongated core received in said shell and arranged generally parallel to the longitudinal axis of said shell, a secondary winding positioned on said core and also received in said shell, a coil head located adjacent and closing one end of said shell, said coil head having a longitudinally extending recess which receives one end of said core, a potting material filling the otherwise empty space inside said shell and restraining said shell, said core, said secondary winding and said coil head against axial movement relative to one another, and a primary winding received on said outer generally cylindrical surface of said shell, said coil head including two high tension towers extending outwardly from the remainder thereof and each having a recess for receiving an end portion of a high tension lead, two high tension terminals carried by and passing through said coil head, each of said high tension terminals having an outer portion located in the recess of a respectively associated one of said high tension towers and adapted to make electrical connection with an end portion of a high tension lead inserted in such associated recess, each of said high tension terminals also having an inner portion exposed to the cylindrical chamber defined by said inner surface of said shell, two low tension terminals carried by and passing through said coil head, each of said low tension terminals having an outer portion located on the outer side of said coil head and adapted for electrical connection to an external lead and each of said low tension terminals also having an inner portion exposed to said cylindrical chamber, means connecting the opposite ends of said primary winding to respective ones of said two low tension terminals, and means connecting the opposite ends of said secondary winding respectively to said inner portions of said two high tension terminals.

* * * * *